United States Patent [19]

Hays et al.

[11] Patent Number: 4,618,241

[45] **Date of Patent: * Oct. 21, 1986**

[54] APPARATUS, PROCESS FOR CHARGING TONER PARTICLES

[75] Inventors: Dan A. Hays, Fairport; William H. Wayman, Macedon, both of N.Y.

[73] Assignee: Xerox Corporation, Stamford, Conn.

[ * ] Notice: The portion of the term of this patent subsequent to Jul. 10, 2001 has been disclaimed.

[21] Appl. No.: 588,181

[22] Filed: Mar. 12, 1984

Related U.S. Application Data

[63] Continuation-in-part of Ser. No. 286,784, Jul. 27, 1981, Pat. No. 4,459,009.

[51] Int. Cl.[4] ..... G03G 15/08

[52] U.S. Cl. ..... 355/3 DD; 355/3 CH; 430/120

[58] Field of Search ..... 355/3 R, 3 DD, 3 CH; 118/653, 654, 656, 661, 644; 430/102, 120

[56] References Cited

U.S. PATENT DOCUMENTS

| | | | |
|---|---|---|---|
| 3,152,012 | 10/1964 | Schaffert | 355/3 DD X |
| 3,804,511 | 4/1974 | Rait et al. | 355/17 |
| 3,854,813 | 12/1974 | Kaufman | 355/10 |
| 3,909,258 | 9/1975 | Kotz | 96/1 |
| 4,194,830 | 3/1980 | Ohnuma et al. | 355/3 DD |
| 4,206,064 | 6/1980 | Kiuchi et al. | 430/106 |
| 4,227,796 | 10/1980 | Kamp et al. | 355/3 DD |
| 4,231,319 | 11/1980 | Waibel et al. | 355/3 DD X |
| 4,337,724 | 7/1982 | Hosono et al. | 355/3 DD X |
| 4,459,009 | 7/1984 | Hays et al. | 355/3 DD |
| 4,505,573 | 3/1985 | Brewington et al. | 355/3 DD |

*Primary Examiner*—Fred L. Braun
*Attorney, Agent, or Firm*—E. O. Palazzo

[57] ABSTRACT

An apparatus and process for charging toner particles wherein the apparatus contains in operative relationship a rotating means for metering insulating toner particles and a deflected charging means for transporting insulating toner particles, the means for metering, and the means for transporting being self-spaced by insulating toner particles situated therebetween, said means for metering and said means for transporting biased to a predetermined potential, and wherein the means for transporting contains a triboelectrically active coating thereon. Also disclosed are imaging devices incorporating these apparatuses and improved process for charging non-magnetic insulating toner particles which comprises (1) providing a rotating metering means, (2) providing a deflected transporting means containing a triboelectrically active coating thereover, (3) depositing weakly charged insulating toner particles on the transporting means, (4) contacting the weakly charged toner particles with the triboelectrically active coating, said contact occurring in a charging zone situated between the rotating means and the deflected transporting means, (5) causing the rotating means to move in a direction opposite to the direction of movement of the deflected transporting means, the rotating means and the means for transporting being self-spaced by the toner particles contained therebetween, wherein the toner particles are charged to an appropriate polarity in a charging zone situated between the rotating means and the deflected transporting means.

66 Claims, 9 Drawing Figures

APPARATUS, PROCESS FOR CHARGING TONER PARTICLES

BACKGROUND OF THE INVENTION

This application is a continuation-in-part application of U.S. Ser. No. 286,784, filed July 27, 1981, now U.S. Pat. No. 4,459,009, the disclosure of which is totally incorporated herein by reference, in the names of D. A. Hays and W. H. Wayman and entitled "Apparatus, Process for Charging Toner Particles."

The present invention relates generally to a unique development system, and more specifically the present invention is directed to an apparatus and process for charging insulating toner particles. In one embodiment the present invention is directed to an apparatus and process for simultaneously metering and charging insulating toner particles to a positive or negative polarity, by delivering such particles into rubbing contact with a charging means, enabling the efficient and effective rapid charging of insulating toner particles, without carrier particles.

The development of images by numerous methods, including electrostatographic means is well known. In these systems toner particles are deposited on an electrostatic latent image contained on an insulating surface, such as selenium, using for example the development methods as described in U.S. Pat. No. 3,618,552, cascade development, U.S. Pat. Nos. 2,874,063, 3,251,706 and 3,357,402, magnetic brush development, U.S. Pat. No. 2,217,776 powder cloud development, and U.S. Pat. No. 3,166,432, touchdown development. The cascade development method and powder cloud development method are especially well adapted for the development of line images common to business documents. Images which contain solid areas are, however, sometimes not faithfully reproduced by these methods, accordingly, magnetic brush development systems are employed to reproduce both lines and solid areas.

Magnetic brush development systems employing two-component developer mixtures comprised of toner particles and carrier particles are thus extensively used in electrophotographic devices such they generally provide for the production of high quality images, including dense solid areas, and also reduce unwanted toner deposition in background areas. Nevertheless, there continues to be problems in the design of simple, inexpensive and efficient two-component systems with long-term stability, which problems are in part caused by the need to generate a triboelectric charge on the toner particles with a desired polarity of sufficient magnitude. Also, in the prior art systems, vigorous developer mixing, which is accomplished in a reservoir or sump using a mixing means such as a paddle-wheel, so as to provide for the continual multiple contacts between toner particles and carrier particles, is required to quickly charge uncharged toner particles added to the developer mixture. This continual mixing of the developer composition causes toner smearing on the carrier particles, and consequently irreversible degradation in the ability of the carrier particles to triboelectrically charge the toner particles, such degradation usually resulting in inferior copy quality, including undesirable increased background development. Additionally, the xerographic development properties of two-component developer compositions is dependent on the concentration of toner particles in the developer mixture, therefore in order to maintain stable xerographic development properties during cyclic machine operation, the toner concentration is monitored by a device which controls the rate at which toner particles are dispersed to the developer reservoir. The components and hardware required for such toner concentration control device adds complexity and cost to two-component systems.

Furthermore, present two-component magnetic brush sytems are generally inherently inefficient primarily because only a small amount of toner particles which are transported through the development zone are available for deposition onto the image bearing member, since for example, the magnetic field in the development zone tends to stiffen the developer, thus only those toner particles immediately adjacent to the imaging member are available for development. Should the developer composition in these systems be electrically insulating, an additional limitation is imposed on the development efficiency, as developer particles entering the development zone have a neutral charge, and deposition of charged toner particles onto the imaging member produces a layer of oppositely charged developer which opposes further toner deposition. The utilization of conductive developer compositions, however, improves development efficiency since a net-charged developer layer ordinarily produced by toner deposition onto the imaging member is dissipated by such compositions. In these systems, the developer composition conductivity is a complex function of, for example, the composition of the carrier materials used, the concentration of the toner particles, and the intensity of the magnetic field, therefore achieving high quality development for extended time periods with conductive developer compositions continues to be a problem. In view of some of the disadvantages of two component devices, considerable efforts have been directed to designing systems which utilize toner particles only, reference for example, U.S. Pat. No. 2,846,333, which discloses single component developer compositions that are comprised of resins, colorants, and magnetic materials. Generally, these systems eliminate the need for a developer reservoir, a toner dispenser, and toner concentration control means. Most of the single component development systems, especially those systems that are in commercial use utilize conductive toner particles, whereby imagewise toner deposition onto the imaging member is obtained by induction toner charging. The electrostatic transfer of conductive toner particles to plain paper is, however, usually inefficient, since the charge on the toner particles can be reversed by induction charging with plain (conductive) paper. Electrophotographic systems employing conductive single component toner particles, therefore, usually require a special (overcoated) paper to achieve sufficient electrostatic toner transfer.

Additionally, in single component development systems containing conductive toner particles, the control of undesirable background, or background suppression cannot be achieved with electrostatic forces, as the toner particles are inductively charged, and deposited on the image bearing member, which is not the situation in two component development systems, wherein the control of background development is accomplished by an electrostatic force acting on the triboelectrically charged toner particles, causing such particles to be directed away from the image bearing member. Should background suppression be desired in single component systems using conductive toner particles, it is usually obtained by reducing the electrostatic force to near zero, followed by generating a magnetic force, which force is derived from a magnetic field originating from a magnet assembly acting on the conductive toner particles loaded with magnetic particles. Since the magnetic force acting on such toner particles is usually weaker than electrostatic forces, background control with single component systems utilizing conductive toner compositions has not always been satisfactory.

Another disadvantage associated with single component development compositions is that a large amount of magnetic material is necessary, at least about 50 percent in some instances, in order to allow for toner transport, and to provide for proper background control. Accordingly, the optical density of toner particles loaded with magnetic materials, such as magnetite, is sufficiently high to negate the effect of adding other light absorbing materials, such as carbon black. Further, the strongly light absorbing properties of magnetic toner particles precludes the production of colored magnetic toner for use in color imaging systems, by the addition of dyes and pigments.

While improvements have been made in the process, apparatus and materials for the development of latent electrostatic images, there continues to be a need for processes and apparatus which will improve the quality of development, are efficient, simple in design, and economical. In particular, there is a need for a single-component imaging system wherein insulative, non-magnetic, and colored toner particles are appropriately charged, and there is obtained two-component image quality utilizing a single-component development method, apparatus and insulative single-component toner particles so as to enable the efficient electrostatic transfer of such particles to plain paper. Also there is a need for processes and apparatus, where single-component toner particles are metered onto a transporting member, and simultaneously rapidly charged to a desired polarity. Further, there is a need for the provision of an apparatus and process, where background is substantially controlled and eliminated by electrostatic forces, and where the reliability of the system hardware, and materials is increased. Additionally, there continues to be a need for an apparatus and process which will allow the uniform development of both fine lines, and large solid areas of an electrostatic latent image, while obtaining minimum background density.

SUMMARY OF THE INVENTION

It is therefore a feature of the present invention to provide a development process, and a development apparatus which overcomes the above-noted disadvantages.

It is a further feature of the present invention to provide a single component development system, wherein two component image quality is obtained.

Yet another feature of the present invention is the provision of an improved development apparatus, wherein toner particles are simultaneously metered and charged by a metering means, such as a metering roll, or a transporting means.

An additional feature of the present invention is the provision of a process and apparatus which allows the rapid charging of toner particles to a desired polarity, either positive, or negative, such charging being consistent over extended periods of time, and not being dependent on the interaction of toner particles with numerous carrier particles.

Another feature of the present invention is the provision of a process and apparatus, wherein a single effective carrier particle, or bead, is employed to accomplish the charging of the toner particles.

An additional feature of the present invention is the provision of an apparatus and process which provides for the excellent transfer of toner particles to plain bond paper, and allows for the control of undesirable background utilizing electrostatic forces.

Another feature of the present invention is the provision of an apparatus and process which allows the development of color images without utilizing magnetic materials.

A further additional feature of the present invention is the provision of an improved apparatus, and process which provides for the transport of toner particles utilizing a non-magnetic electrostatic transport system.

These and other features of the present invention are accomplished in one aspect by providing a development apparatus and process for charging non-magnetic insulating toner particles, comprising a moving toner transport means, also referred to herein as a donor means, or donor belt means, and an adjacent metering means or charging means preferably moving in a direction opposite to the direction of movement of the donor means. In one embodiment, the moving donor means contains thereover a triboelectrically active coating material, and the metering means is comprised of an uncoated metering roll. As disclosed in the parent application identified herein, the metering roll may contain a triboelectrically active coating thereon, however, with respect to the present invention, the metering roll without a coating can also function for the purpose of providing a triboelectric relationship with the toner particles. Additionally, the transporting means in a preferred embodiment of the present invention is overcoated with a material which is both textured and triboelectrically active, including compositions such as Teflon S, available from E. I. duPont, to enable the transporting means to more effectively meter and charge the toner particles for transport to a development zone.

Movement of the donor means directs non-magnetic insulating toner particles to a nip or charging zone, as illustrated hereinafter, whereat the frictional rubbing between the toner particles and the metering means and donor means causes such particles to be triboelectrically charged. The application of an electrical bias to the charging means relative to the donor means, causes electrostatic forces to act on the charged toner particles in close proximity to the entrance of the charging nip, or charging zone, thus toner particles which have been charged to the same polarity as the bias roll are electrostatically directed and attracted to the donor means. Accordingly, the entrance to the charging nip functions similar to an electrostatic toner charge filtering means. Also the system of the present invention allows the desirable extensive agitation and tumbling of toner particles in the toner supply means.

As illustrated in the parent application, wrong-sign charged toner particles, which are transported by the charging means in a direction opposite to that of the donor means, contact a doctor-blade seal means, which removes and returns the particles to a developer reservoir. It is desirable to remove the wrong-sign charged toner particles otherwise these particles are deposited on the donor means at the exit region of the charging nip, which would adversely affect the charge distribution of the toner particles contained on the donor means.

The net charge on the toner particles contained in the supply reservoir or developer sump is near zero, however, such a charge is distributed with approximately equal numbers of positive and negative charges, as illustrated in FIG. 1, for example. Those toner particles which are electrostatically attracted to the donor means in the region prior to the charging nip are drawn therethrough while the toner charge is amplified by extensive rubbing between the toner particles and the triboelectrically active materials associated with the charging means and donor means. This rubbing action provides the toner particles with an appropriate charge in a rapid time period. Subsequently, the charged toner particles emerge from the charging nip exit and can be conveyed, by electrical attraction to the donor means, to an electrostatic latent image bearing member, where they are imagewise deposited therein by electrostatic attraction, with unused toner particles remaining on the donor substrate until they are returned to the toner reservoir.

The present invention in one aspect is thus directed to an apparatus for charging toner particles comprised in operative relationship of a means for charging insulating toner particles, and a means for transporting insulating toner particles, said means for charging, and said means for transporting, biased to a predetermined potential.

In another illustrative embodiment, the present invention is directed to an apparatus for simultaneously metering and charging nonmagnetic insulating toner particles, comprised in operative relationship of a means for metering non-magnetic insulating toner particles, a means for transporting and charging the toner particles, a means for supplying non-magnetic insulating toner particles to the transporting means, a means for applying a bias to the metering means, a means for applying a bias to the transport means, a means for removing toner particles from the metering means, wherein toner particles are charged to the appropriate polarity and magnitude in a charging zone situated between said metering means, and said transport means.

The present invention in a further illustrative embodiment is directed to an apparatus for simultaneously metering and charging non-magnetic insulating toner particles comprised in operative relationship of a metering roll means, a transport donor belt means containing a triboelectrically active coating thereon, a doctor blade means for the metering means, a toner supply reservoir means containing therein weakly charged insulating toner particles possessing about an equal number of positive and negative charges thereon, a drive roll means, an idler roll means, a tensioning means, an imaging means, a voltage source means for the metering roll means, a voltage source means for the drive roll means and the transport-donor belt means, said metering roll means moving in a direction opposite to the direction of movement of the transport-donor belt means.

Another illustrative embodiment of the present invention encompasses an apparatus for simultaneously metering and charging non-magnetic insulating toner particles, which comprises in operative relationship a metering roll means, a transporting means containing thereon a triboelectrically active coating, a drive roll means, an idler roll means, said transporting means forming a path of movement around said drive roll means and said idler roll means, a toner supply reservoir means, containing therein weakly charged insulating toner particles possessing about an equal number of positive and negative charges thereon, a voltage source means for the metering roll means, a voltage source means for the drive roll means, and the transporting means, a tensioning means, an imaging member means, wherein the transporting means is positioned so as to maintain a constant fixed distance between said metering roll means and said transport means, and/or is self-spaced from the metering roll means by insulating toner particles, said metering roll means moving in a direction opposite to the direction of movement of the transport means; and an apparatus for metering and charging non-magnetic insulating toner particles comprised in operative relationship of a metering roll means, a compliant transport-donor roll means containing thereon a triboelectrically active coating, a toner supply reservoir means containing therein weakly charged toner particles, a voltage source means for the metering roll means, and a voltage source means for the compliant roller means, wherein toner particles are charged in a zone encompassed by said metering roll means, and said compliant roll means, said metering roll means preferably moving in a direction opposite to the direction of movement of said compliant roll means. In an alternative embodiment of the present invention, the metering roll means can be compliant while the transport-donor means can be rigid.

The present invention in another illustrative embodiment is directed to an electrostatographic imaging device comprised of a charging means, an imaging means, a development means, a fixing means, and a fusing means, the improvement residing in the development means which is comprised of an apparatus for charging toner particles comprised in operative relationship of a means for metering and charging insulating toner particles, and a means for transporting insulating toner particles, said means for charging, and said means for transporting, biased to a predetermined potential, and a process for charging insulating toner particles which comprises (1) providing a means for metering insulating toner particles, (2) providing a means for transporting and charging toner particles, which means contains thereover a triboelectrically active coating, (3) depositing weakly charged toner particles on the transporting means and (4) contacting the weakly charged toner particles with the triboelectrically active coating in a charging zone situated between the means for metering and the means for transporting, whereat charges on the toner particles are amplified to a positive or negative polarity.

It is to be understood that with respect to all the embodiments described herein, including those represented in the figures, that the metering means can also function in a manner so as to create a triboelectric relationship with the uncharged toner particles situated in the charging zone, and further charging of the toner particles can be effected in the absence of a triboelectrically active material coating situated on the surface of the transporting means. Moreover, the transporting means is preferably textured and is comprised of a material that is resistant, such as a roll containing a sleeve of chloroprene having dispersed therein as a dopant for conductivity purposes carbon black particles, which sleeve is bonded with a conductive adhesive material to a conducting foam metering roll.

DESCRIPTION OF THE PREFERRED EMBODIMENT

The process and apparatus of the present invention and various alternative embodiments will now be described with reference to the Figures wherein:

FIG. 9 is a schematic illustrating the use of the apparatus and process of the present invention, as shown in FIG. 4, in an electrostatographic imaging system in which the development nip is formed by a blade backed photoreceptor belt.

Figure 1:
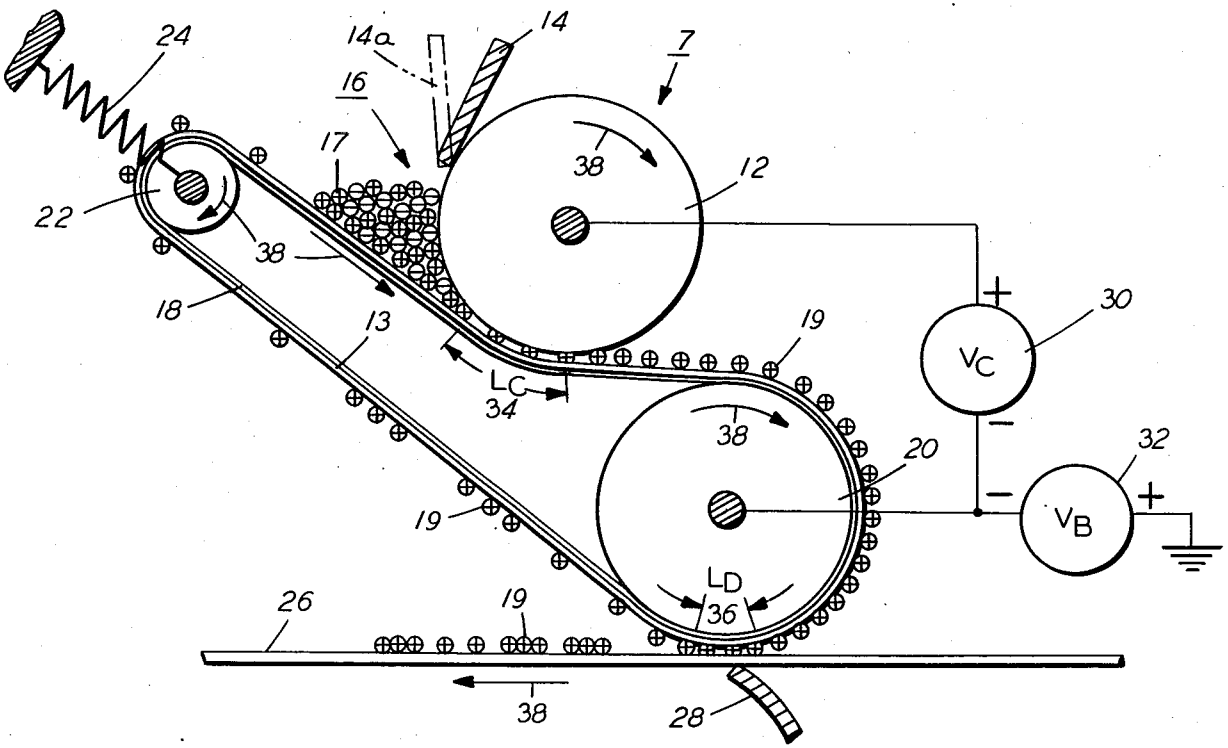
FIGS. 1 and 9 are schematic views of embodiments of the apparatus and process of the present invention.

Illustrated in FIG. 1 is the apparatus and process of the present invention, generally designated 7 comprising a roll means 12, which functions as a metering component, or a metering/charging means, a doctor blade means 14, illustrated at one angle, or doctor blade means 14*a*, illustrated at another angle in relationship to roll 12, a toner supply reservoir means 16, containing weakly charged toner particles 17, possessing an approximate equal number of positive and negative charges thereon, a transport or donor belt means 18, containing thereover a triboelectrically active coating 13, positively charged toner particles 19, a drive roll means 20, an idler roll means 22, a tensioning means 24, a flexible photoreceptor imaging member means 26, a pressure blade means 28, a voltage source means 30($V_C$) for roll 12, a voltage source means 32 ($V_B$) for drive roll 20, and donor belt means 18, a metering charging zone 34 ($L_C$), a development zone 36 ($L_D$), with the direction of movement of the various components being illustrated by the arrows 38. Thus, as shown, in zone 34 ($L_C$), the roll means 12 is moving in a direction opposite to the direction of movement of the donor belt means 18.

In operation, the weakly charged insulating toner particles 17, within the reservoir 16, undergo circular flow primarily since the walls of the reservoir as constituted by the donor belt means 18, and the roll means 12 are continually moving in opposite directions by means such as motors not shown, which promote toner tumbling and agitation. The frictional rubbing between the toner particles 17 and the roll means 12 and the triboelectrically active coating 13 contained on the transport means, charges the toner particles by triboelectric charging. An additional source of toner charge is obtained at the doctor blade means 14, or 14*a*, where the accumulation and removal of toner particles clinging to the roll means 12 induces air breakdown (ions) causing neutralization of the charged toner layer. The toner particles 17 in the reservoir 16 are primarily weakly charged with approximately equal amounts of positive and negative charges. Accordingly, for example, when a positive potential, $V_C$ of about 100 volts is applied to the roll means 12, those toner particles with a positive charge are electrostatically deposited on the donor belt means 18 at the entrance to the metering/charging zone 34. Frictional rubbing, in zone 34, of the toner particles with roll 12 and the coating 13, moving in a direction opposite to the movement of the roll means 12, increases the positive charge on the insulating toner particles as a result of triboelectric charging between the coating 13, which are comprised of electronegative materials in this illustration, and electropositive toner particles 17. The positively charged toner particles then emerge from the charging zone 34 and can be transported to the flexible imaging member 26. During transport, the positively charged toner particles adhere to the donor belt means 18, by electrostatic attraction.

The deflected donor belt means 18 forms a path around drive roller means 20, and idler roll means 22, which allows the positively charged insulating toner particles 19 to be transported into rubbing contact with an electrostatic latent image, not shown, on the flexible imaging member 26. As illustrated, the donor belt means 18 is subjected to a tensioning means 24, the belt being positioned in such a manner so as to cause it to be wrapped in an arc in close proximity to roll 12, with the donor belt 18 being self-spaced from roll 12 by the toner particles contained therebetween. Generally, the arc of belt 18 ranges from about 10 degrees to about 50 degrees.

The toner particles 19 are transferred from the donor belt means 18, to the flexible imaging member means 26 as a result of voltage 32 ($V_B$), and the imagewise attraction for such particles by the imaging member 26, charged to a negative potential. Pressure blade 28 provides a sufficient force to insure intimate contact of the positively charged toner particles 19, with the imaging member 26 for the distance 36 ($L_D$), the imaging member 26, being self-spaced from the donor belt means 18, by the positively charged insulating toner particles 19 contained therebetween, Unused toner particles 19 not deposited on imaging member 26 are returned to the toner reservoir 16 by belt 18. The doctor blade means 14 or 14*a*, contains the toner particles in the toner reservoir 16, and also serves to remove any toner particles on roll 12 so that they will not deposit on belt 18, and adversely effect charging and metering. Coatings 13 have optionally dispersed therein a charge dissipating material, such as carbon black for the purpose of accepting and eliminating negative charges obtained from the toner particles 17. When it is desired to impart a negative polarity to the toner particles 17, the coating 13 is selected so as to have a negative triboelectric relationship with the particles 17, that is, it is electropositive, and voltage $V_C$ is negative, instead of positive. A triboelectrically active coating can also be situated on the roll means 12, therefore in this embodiment, triboelectrically active coatings are contained on the surfaces of the transporting means 18 and the roll means 12.

While it is not desired to be limited by theory, in many of the embodiments illustrated hereinbefore, positive charges are supplied to the toner particles 17 by the roll means 12 and triboelectrically active coating 13, as a result of the triboelectric charging relationship between this coating and the toner particles 17, thereby resulting in positively charged toner particles. The weakly positively charged particles 17 lose negative charges and gain positive charges as a result of their rubbing contact with roll 12, and belt 18 in charging zone 34, ($L_C$). The resulting positively charged toner particles adhere to belt 18 as they migrate to and around roll 20, in view of the electrostatic attraction of the particles to the belt, thus additives such as magnetic pigments are not needed.

The roll 12 is an important feature of the present invention, in that it may also function as a source of charge, similar to carrier particles in a two component system, and also controls or meters the amount of toner particles allowed to deposit on belt 18. Thus the density of toner particles present on donor belt means 18, which density is a primary factor in establishing and maintaining the distance of separation between belt means 18, and roll means 12, can be controlled by the roll 12 means, and the process conditions associated with this roll. Also of importance is the transporting means 18 which is a preferred embodiment of the present invention contains thereover a coating which is both textured and triboelectrically active, which coating serves to establish a triboelectric relationship with the uncharged toner particles contained in the charging zone enabling such particles to be charged to the appropriate magnitude and the desired positive or negative polarity.

Figure 2:
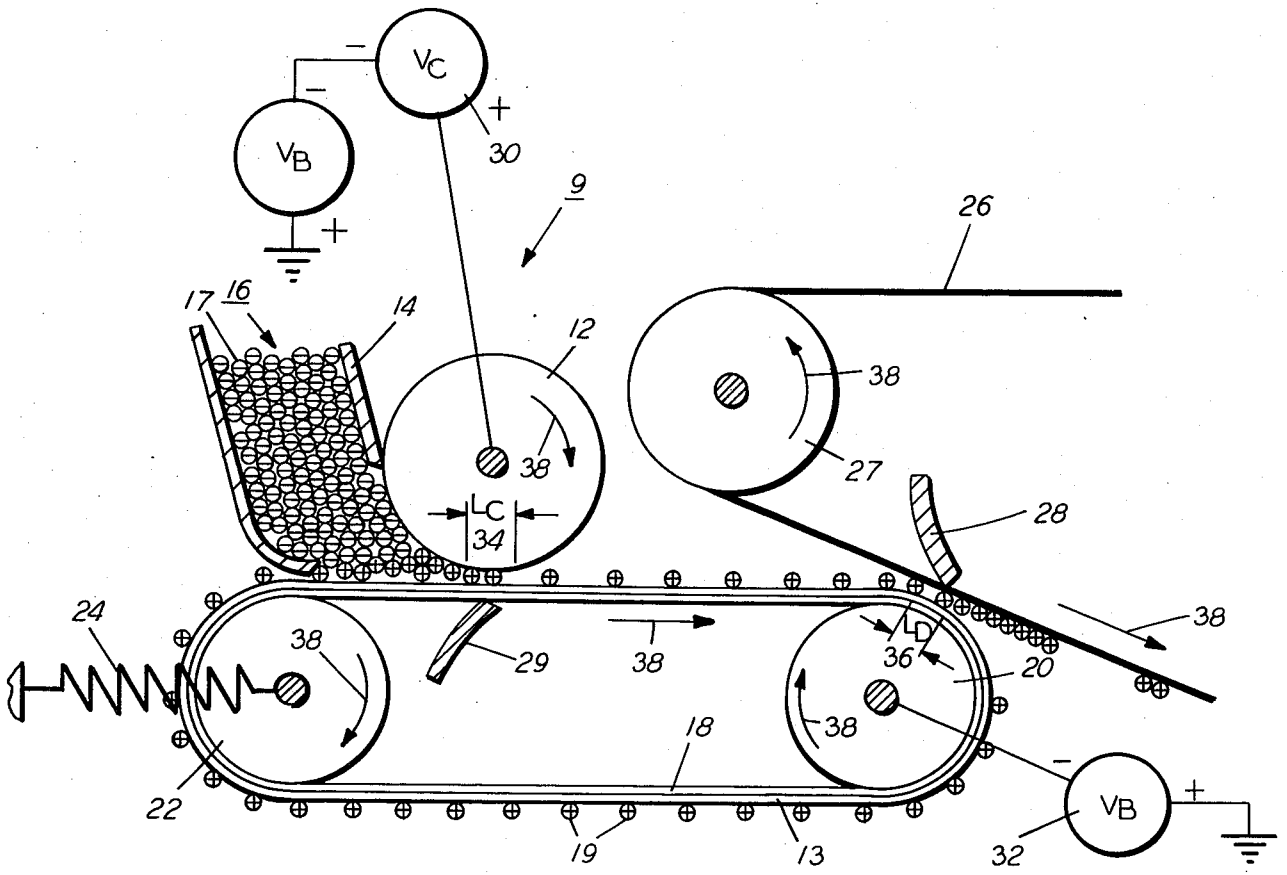
FIG. 2 is a schematic view of another embodiment of the apparatus and process of the present invention.

Illustrated in FIG. 2 is another embodiment of the process and apparatus of the present invention generally designated 9, comprising a metering roll means 12, a doctor blade seal means 14, a toner supply means 16, containing toner particles 17, possessing an approximate equal number of weakly charged positive, and weakly charged negative toner particles, a donor belt means 18 containing thereover a triboelectrically active coating 13, positively charged toner particles 19, a drive roll means 20, an idler roll means 22, a tensioning means 24, a flexible imaging member means 26, a roll means 27, a pressure blade means 28, a pressure blade means 29 for the metering/charging zone 34, a voltage source 30 ($V_C$), a voltage source 32 ($V_B$), a charging zone 34 ($L_C$), a development zone 36 ($L_D$), with the components moving in the direction as shown by the arrows 38.

The process and apparatus illustrated in FIG. 2, operates in substantially the same manner as described herein with reference to FIG. 1, accordingly, thus in summary the weakly charged insulating toner particles 17 are deposited on the donor belt means 18 as a result of movement of the components, gravitational forces, and the electrostatic force from voltage source means 30 ($V_C$), wherein the toner particles are brought into rubbing contact with the roll means 12 and donor belt means 18, in the charging zone 34 ($L_C$) thus resulting in positively charged toner particles 19. As contrasted to FIG. 1, the donor belt means 18 is not arced in relationship to roll 12, rather, belt 18 makes a tangential contact with roll means 12, and is self-spaced therefrom by insulating toner particles with the nip pressure being supplied by a compliant blade means 29 positioned on the backside of the belt 18. The positively charged toner particles 19 are then transported on the donor belt 18, until contacting the flexible imaging member 26, in the development zone ($L_D$), wherein they are transferred to the imaging member, which has been charged negatively. Pressure blade 28 provides sufficient force to insure contact of the positively charged toner particles, with the imaging member 26, for the distance 36 ($L_D$). Unused positively charged toner particles are, as shown, returned to the toner reservoir 16, for reuse in the system.

Figure 3:
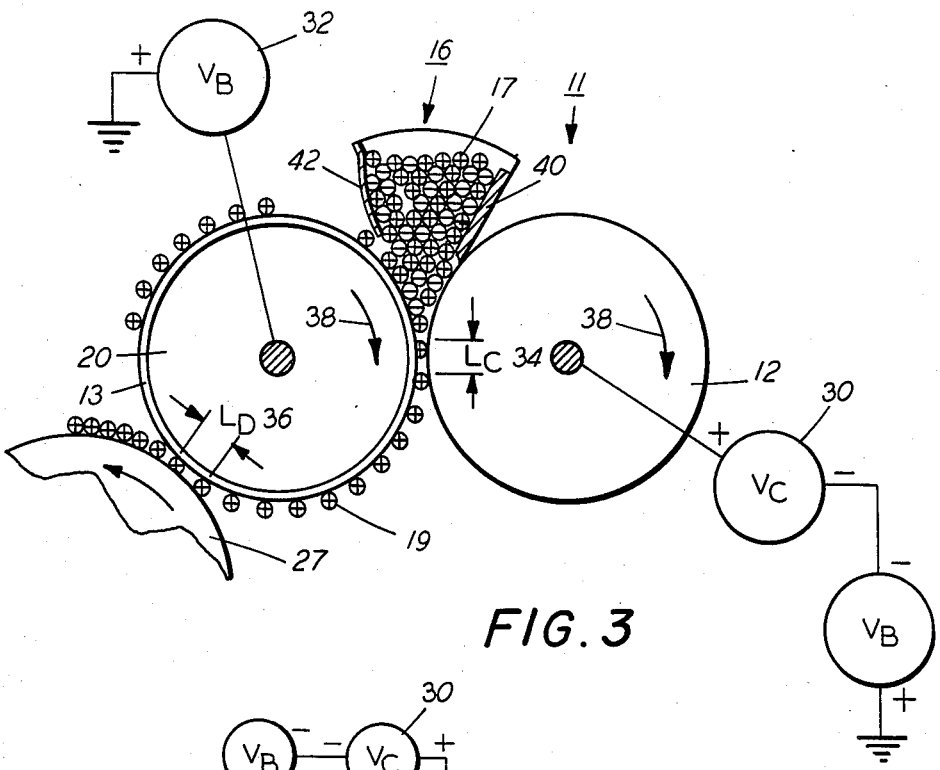
FIG. 3 is a schematic view of a further embodiment of the apparatus and process of the present invention.

Illustrated in FIG. 3 is another embodiment of the apparatus and process of the present invention generally designated 11, comprising a rigid or compliant roll means 12, a toner supply reservoir means 16, containing weakly charged insulating non-magnetic toner particles 17, positively charged toner particles 19, a compliant donor roll 20, with a triboelectrically active coating 13 thereover, a rigid photoreceptor imaging member means 27, a doctor blade seal means 40, a wiper blade seal means 42, a voltage source 30 ($V_C$), a voltage source 32 ($V_B$), a charging zone 34 ($L_C$), a development zone 36 ($L_D$), with the components moving in the directions as shown by the arrows 38. In this simplified version of the apparatus and process of the present invention, toner particles 17 are supplied to the charging nip 34 between the roll means 12, and a compliant donor roll means 20. As a result of the contact between tone particles 17, and the roll 12 and coating 13, in charging zone 34, the toner particles 17 acquire a positive charge thereon. The positively charged toner particles 19 are then transported by the compliant donor roll means 20, such particles adhering to the roll as a result of electrostatic attraction, to the rigid imaging member means 27, wherein they are attracted thereto in the development zone 36. Unused toner particles are returned to the toner supply reservoir 16, as shown. In this embodiment the roll means 12 may also be compliant, thus both rolls 12 and 20 can be compliant. Generally the compliant rolls can be comprised of numerous materials such as an electroformed nickel sleeve bonded to a foam roll and the like.

Figure 4:
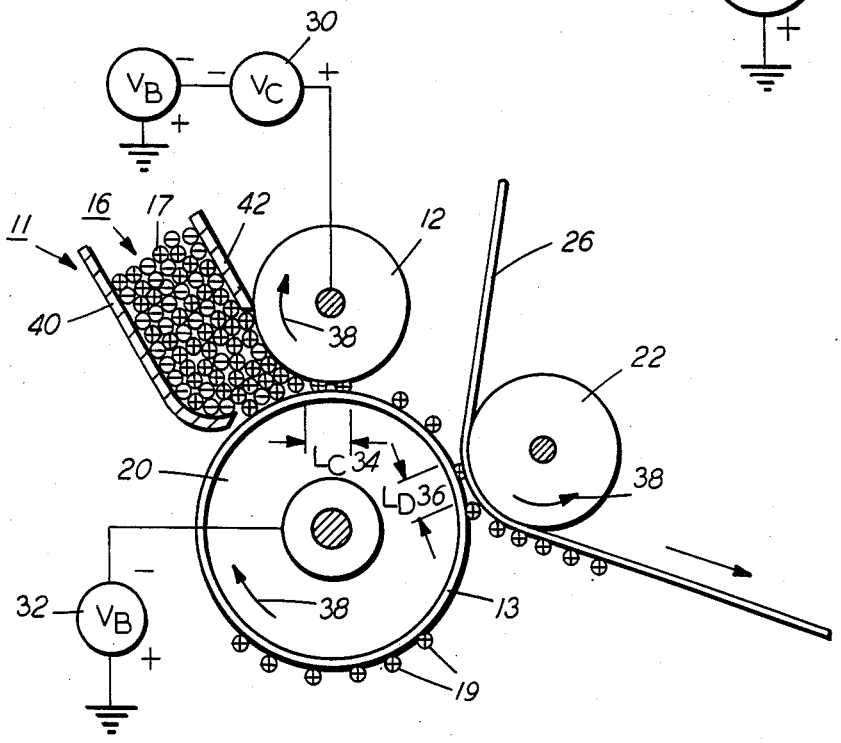
FIG. 4 is a schematic view of yet another embodiment of the apparatus and process of the present invention.
Figure 5:
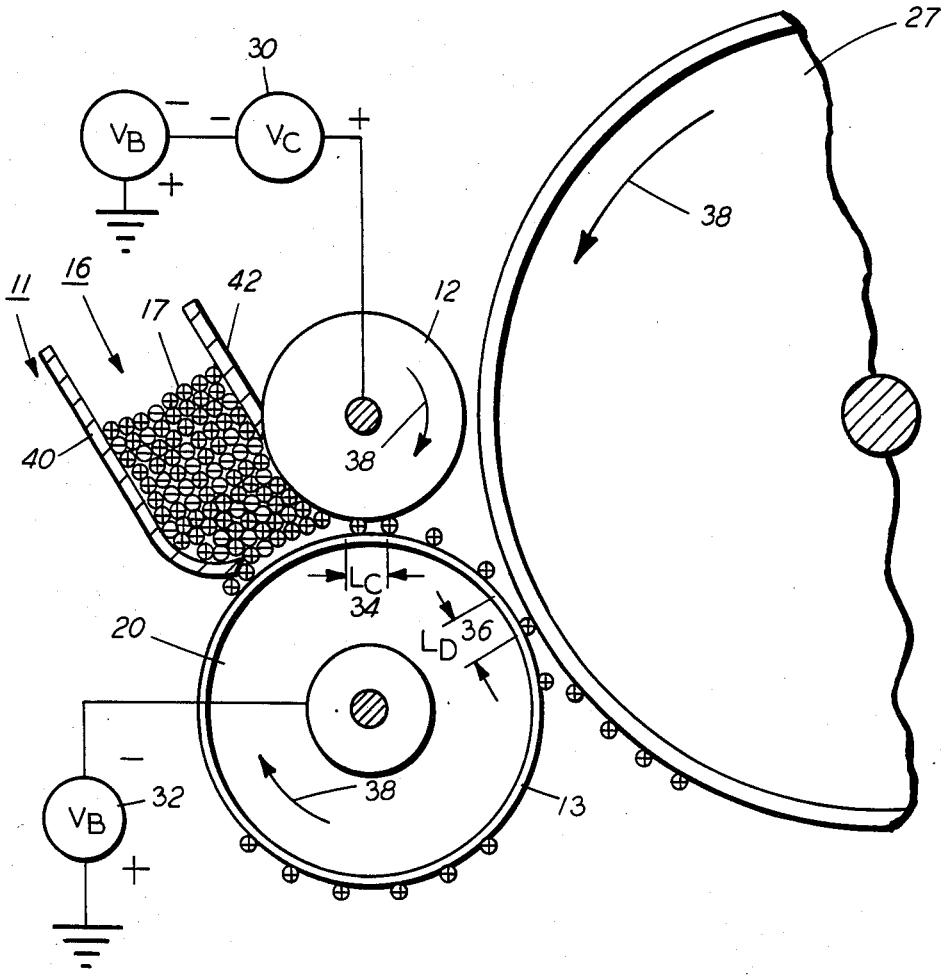
FIG. 5 is a schematic view of another embodiment of the apparatus and process of the present invention.

Illustrated in FIGS. 4 and 5 are other embodiments of the apparatus and process of the present invention. These embodiments illustrate important different configurations of FIG. 3, one embodiment containing a flexible imaging means, FIG. 4, and one embodiment containing a rigid imaging means, FIG. 5. In these Figures like components are indicated by identical reference numerals as described with regard to the other Figures, especially FIG. 3, and the operation of the apparatus and process as illustrated in FIGS. 4 and 5 is substantially identical to the operation of the apparatus and process illustrated in FIG. 3. Shown in FIGS. 4 and 5 are rigid or compliant roll means 12, toner supply reservoir means 16, containing weakly charged non-magnetic toner particles 17, a compliant donor roll means 20, triboelectrically active coating 13, idler roll means 22, a flexible photoreceptor imaging member means 26, FIG. 4 only, a rigid photoreceptor means 27, FIG. 5 only, a doctor blade seal means 40, a wiper blade seal means 42, a voltage source 30 ($V_C$), a voltage source 32 ($V_B$), a charging zone 34 ($L_C$), a development zone 36 ($V_D$), with the components moving in the direction of the arrows 38.

In these versions of the apparatus and process of the present invention, in summary, weakly charged toner particles 17 are supplied to the charging nip 34 between the roll means 12 and a compliant donor roll means 20. As a result of the movement of roll means 12, and roll means 20, toner particles 17 contact the roll 12 and the triboelectrically coating 13 contained on the transporting means 20 in charging zone 34 ($L_C$), causing toner particles to acquire a positive charge thereon. The positively charged toner particles are then transported by the compliant donor roll means 20, to the flexible imaging member 26, FIG. 4 or to the rigid imaging member 27, FIG. 5, wherein they are attracted thereto in the development zone 36 ($L_D$). Unused toner particles are returned to the toner reservoir 16, by roll means 20, as shown.

Figure 6:
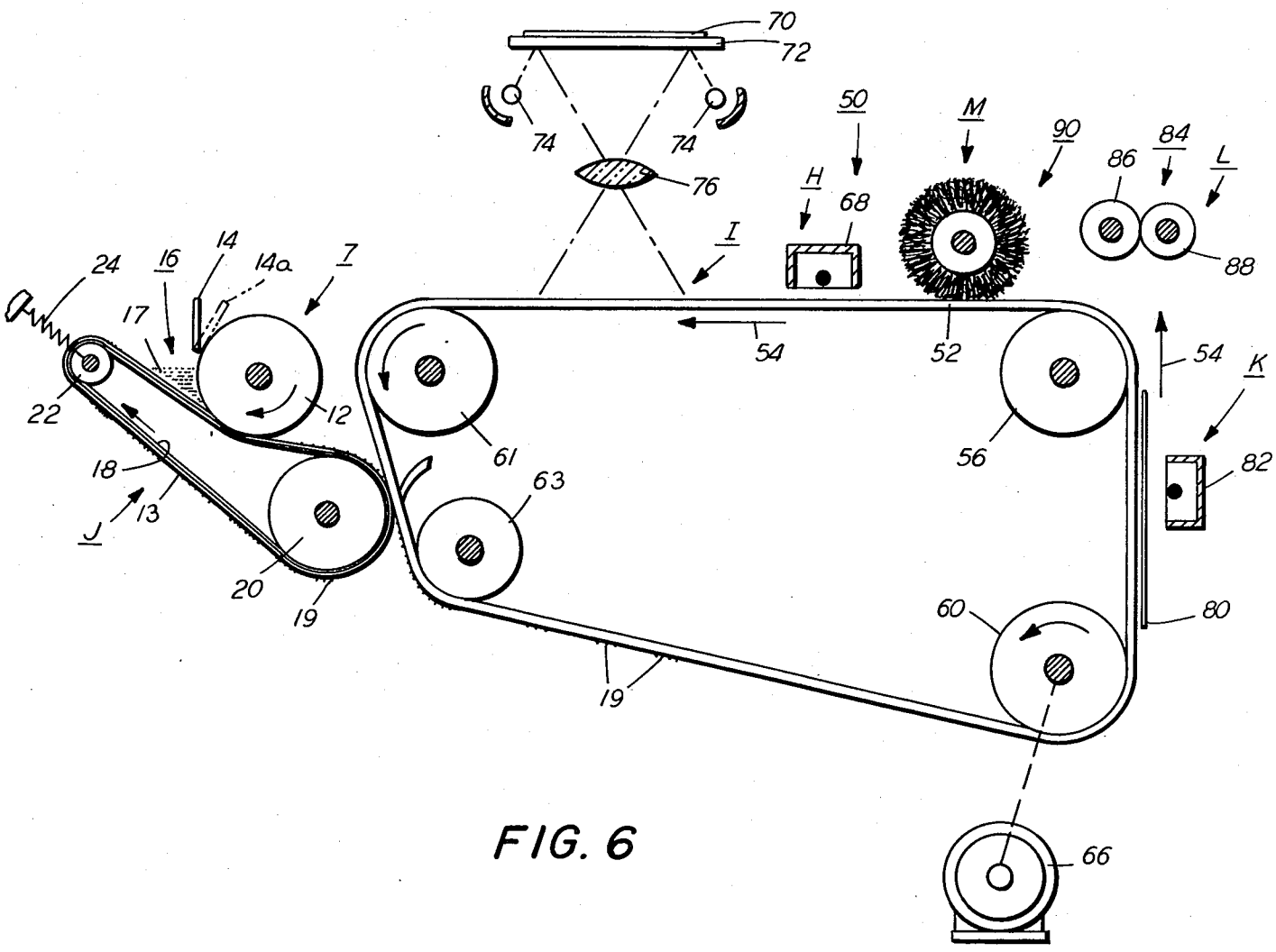
FIG. 6 is a schematic illustrating the use of the apparatus and process of the present invention as shown in FIG. 1, in an electrostatographic imaging system.
Figure 7:
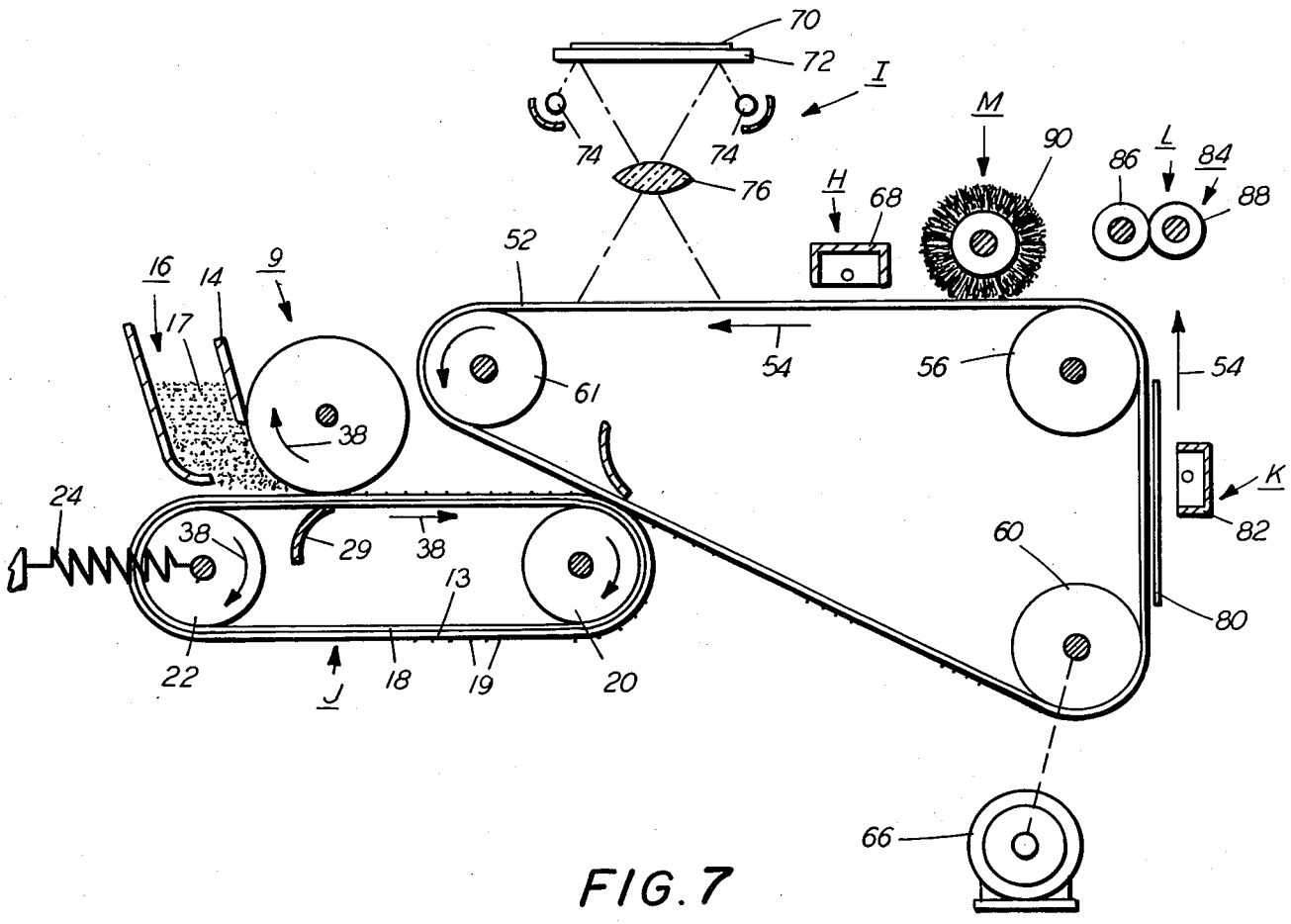
FIG. 7 is a schematic illustrating the use of the apparatus and process of the present invention as shown in FIG. 2, in an electrostatographic imaging system.
Figure 8:
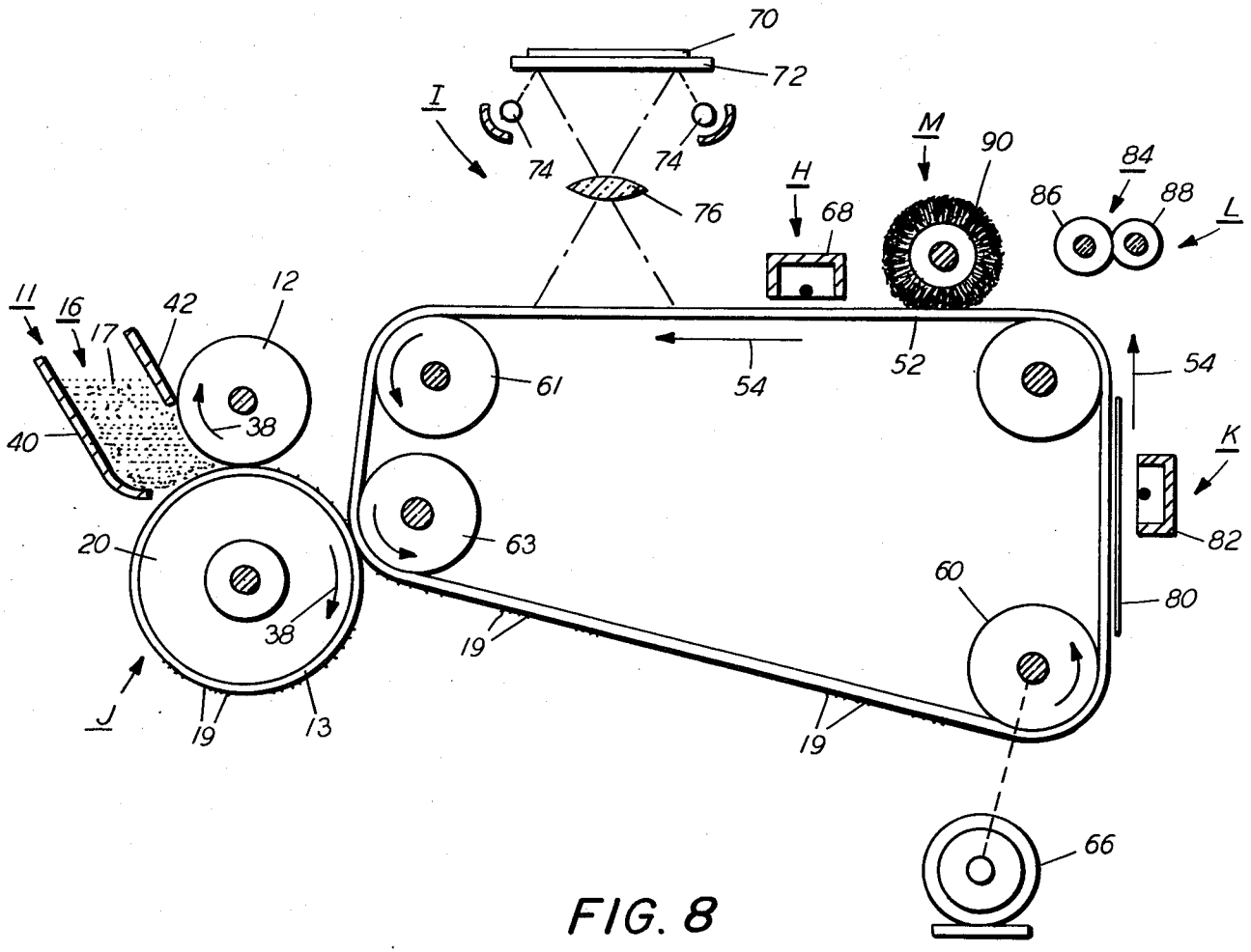
FIG. 8 is a schematic illustrating the use of the apparatus and process of the present invention as shown in FIG. 4, in an electrostatographic imaging system.

The apparatus and process of the present invention can be utilized in various imaging systems, including electrostatic latent imaging systems as shown for example in FIGS. 6, 7, and 8. In FIG. 6 there is illustrated a xerographic imaging system generally designated 50, employing an imaging member 52, which corresponds to the imaging member 26, of FIGS. 1, 2 and 4. In this embodiment of the present invention the imaging member 52, can be comprised of a substrate, overcoated with a transport layer containing N,N,N',N'-tetraphenyl-[1,1'-biphenyl]4,4'-diamine, or similar diamines dispersed in a polycarbonate, which in turn is overcoated with a generating layer of trigonal selenium. Imaging member 52 moves in the direction of arrow 54 to advance successive portions of the imaging member sequentially through the various processing stations disposed about the path of movement thereof. The imaging member is entrained about a sheet-stripping roller 56, drive roller 60, and rollers 61 and 63. The system can also include a tensioning means, not shown, for the purpose of maintaining imaging member 52 at the desired flexibility, or pressure, which level of tension is relatively low permitting member 52 to be easily deformed. With continued reference to FIG. 6, drive roller 60 is mounted rotatably and in engagement with member 52. Motor 66 rotates roller 60 to advance member 52 in the direction of arrow 54. Roller 60 is coupled to motor 66 by suitable means such as a belt drive. Sheet-stripping roller 56 is freely rotatable so as to readily permit member 52 to move in the direction of arrow 54 with a minimum of friction.

Initially, a portion of imaging member 52 passes through charging station H. At charging station H, a corona generating device, indicated generally by the reference numeral 68, charges the photoconductive surface of imaging member 52 to a relatively high, substantially uniform potential.

The charged portion of the photoconductive surface is then advanced through exposure station I. An original document 70 is positioned face down upon transparent platen 72. Lamps 74 flash light rays onto original document 70, and the light rays reflected therefrom are transmitted through lens 76 forming a light image thereof. Lens 76 focuses the light image onto the charged portion of the photoconductive surface to selectively dissipate the charge thereon. This records an electrostatic latent image on the photoconductive surface, which corresponds to the informational areas contained within original document 70.

Thereafter, imaging member 52 advances the electrostatic latent image recorded thereon to station J wherein it is contacted with positively charged insulating toner particles 19, station J including essentially all the components as shown in FIG. 1, namely in summary, a roll means 12, a doctor blade means 14, illustrated at one angle, or doctor blade means 14*a*, illustrated at another angle, in relationship to roll 12, a toner supply reservoir means 16, containing weakly charged non-magnetic insulating toner particles 17, possessing an approximate equal number of positive and negative charges thereon, a donor belt means 18 with a triboelectrically active coating 13 thereover, positively charged toner particles 19, a drive roll means 20, an idler roll means 22, a tensioning means 24, a pressure blade means 28, a voltage source 30 ($V_C$), for roll 12, a voltage source means 32 ($V_B$) for drive roll 20, and donor belt means 18, a metering charging zone 34 ($L_C$), a development zone 36 ($L_D$), with the direction of movement of the various components shown by the arrows 38. The details for charging and metering the toner particles, and deposition thereof on the imaging member is illustrated with reference to FIG. 1.

Imaging member 52 then advances the toner powder image to transfer station K. At transfer station K, the sheet of support material 80 is moved into contact with the toner powder image, which sheet is advanced to transfer station K by a sheet feeding apparatus (not shown). Preferably, the sheet feeding apparatus includes a feed roll contacting the uppermost sheet of a stack of sheets. The feed roll rotates so as to advance the uppermost sheet from the stack into a chute, which chute directs the advancing sheet of support material into contact with the photoconductive surface of member 52 in a timed sequence, in order that the toner powder image developed thereon contacts the advancing sheet of support material at transfer station K.

Transfer station K includes a corona generating device 82 which sprays ions onto the backside of sheet 80, allowing for the attraction of the toner powder image from the photoconductive surface to sheet 80. After transfer, sheet 80 moves in the direction of arrow 54 onto a conveyor (not shown) to fusing station L.

Fusing station L includes a fuser assembly, indicated generally by the reference numeral 84, which permanently affixes the transferred toner powder image to sheet 80. Preferably, fuser assembly 84 includes a heated fuser roller 86 and a back-up roller 88. Sheet 80 passes between fuser roller 86 and back-up roller 88 with the toner powder image contacting fuser roller 86. In this manner, the toner powder image is permanently affixed to sheet 80. After fusing, a chute guides the advancing sheet 80 to a catch tray for subsequent removal from the printing machine.

Invariably, after the sheet of support material is separated from the photoconductive surface of imaging member 54 some residual particles remain adhering thereto. These residual particles are removed from the photoconductive surface at cleaning station M. Cleaning station L includes a rotatably mounted fibrous brush 90 in contact with the photoconductive surface. The particles are cleaned from the photoconductive surface by the rotation of brush 90 in contact therewith. Subsequent to cleaning, a discharge lamp (not shown) floods the photoconductive surface of member 52 with light to dissipate any residual electrostatic charge remaining thereon prior to the charging thereof for the next successive imaging cycle.

In FIGS. 7 and 8 there is illustrated a substantially similar xerographic imaging apparatus and process as described with reference to FIG. 6, with the exception, for example, that FIG. 7, includes components of FIG. 2, and FIG. 8 includes components of FIG. 4. The operation of the apparatus and process of FIG. 7 is as described herein with reference to FIGS. 2 and 6, while the operation of the apparatus and process of FIG. 8 is as described herein with reference to FIGS. 4 and 6.

Figure 9:
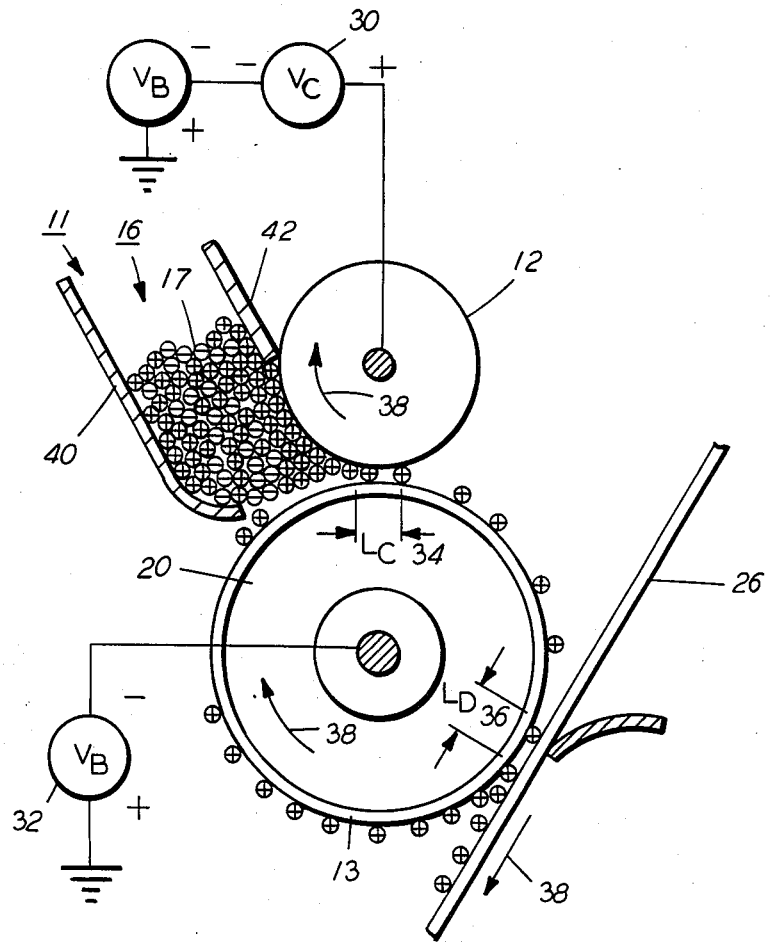

Illustrated in FIG. 9 is essentially the identical apparatus as shown in FIG. 4 wherein identical components are represented by the same reference numerals, with the exception that in FIG. 9, the development nip is situated between roll 20 and a blade backed photoreceptor belt 26. In this embodiment of the present invention, the roll 20 can be a rigid structure, while the metering roll 12 can be compliant.

It is believed that the foregoing description is sufficient for purposes of the present invention to illustrate the general operation of an electrophotographic printing machine incorporating the features of the present invention therein.

The roll 12 can be either rigid or compliant, and while functioning primarily as a metering means, may also act as a charging means. Thus depending upon the materials selected, roll 12 is capable of establishing a triboelectric relationship with the uncharged toner particles. With regard to the rigid roll, the core thereof can be hollow or solid, and may be comprised of numerous known suitable materials including for example, stainless steel, aluminum, steel, iron, electroformed nickel, polymeric substances and the like, providing they are of sufficient strength to be operable in the system. Additionally, for optimum operation, it is preferred that the material be substantially wear-resistant. The preferred material is electroformed nickel. With respect to the compliant rolls, the core may consist of numerous suitable materials, including elastic materials such as polyurethane foams or silicone rubbers, a seamless flexible conductive sleeve including electroformed nickel or an extruded carbon black filled thermoplastic polymer.

The coating 13 contained on the transport roll means can be selected from numerous suitable materials known in the art, including many of the same materials that are employed for coating carrier particles. The coating is selected according to the charge that is desired to be imparted to the toner particles, thus if it is desired to impart a positive charge to the toner particles, a coating capable of acquiring a negative charge thereon is employed, these coatings including various electronegative materials such as polymers, including copolymers of trifluorochloroethylene and vinyl chloride commercially available as FPC 461. Examples of other electronegative materials that can be employed include highly halogenated polymers, such as polyvinylidene fluoride, polytetrachlorofluoroethylenes, perfluoroalkoxylated ethylenes, polytetrafluoroethylenes, polyvinyl chlorides and the like. Should it be desired to impart a negative charge to the insulating toner particles, a coating capable of acquiring a positive charge thereon is employed; examples of such coatings include various electropositive materials like polyvinylpyridenes, terpolymers of methacrylates, such as polymethylmethacrylate, polystyrene/n-butylmethacrylate silane terpolymer, polycaprolactum, and the like. Additionally, there can be selected as coating 13, materials analogous to thermoplastic toner resins, as described hereinafter, containing charge control agents for the purpose of imparting a positive, or negative charge to the toner particles 17. Various suitable charge control agents can be employed, including alkylpyridinium halides, such as cetylpyridinium chloride, quaternary ammonium compounds as disclosed in U.S. Pat. No. 3,970,571, morpholinium compounds, hydrazonium compounds, and the like. Generally, the charge control agent is present in an amount of from about 0.1 percent to about 10 percent.

The thickness of the coating 13 can vary over a wide range and is dependent on many factors including economical considerations, however, generally the thickness of the coating is from about 0.1 mils to about 5 mils, and preferably is from about 1 mil to about 3 mils. In a preferred embodiment, the thickness of the coating 13 is 1 mil, as such a thickness, particularly when employed in the embodiments of the present invention, resulted in superior overall performance.

With further reference to the donor belt means, such as the donor belt means 18 illustrated, for example, in FIGS. 1 and 2, this means can be comprised of numerous suitable materials such as a triboelectrically active material including bare electroformed nickel sleeves preferably processed in a manner which imparts texture to the surface, a polymeric belt doped with carbon black and fillers to impart conductivity thereof, and surface texture to the material. Moreover, the donor belt can consist of various substrates such as aluminized Mylar overcoated with a triboelectrically active material such as a carbon black loaded paint (polymer matrix), or dopants which are conductive agents for the polymers, such as quaternary ammonium salts, or a seamless electroformed nickel belt overcoated with a Krylon ultraflat black paint, commercially available as Krylon 1602. It is preferred that the belt be seamless to prevent toner metering defects. The peak-to-peak variation in the surface texture on the donor belt means 18 ranges from 0.5 micrometers to 5 micrometers, with a spatial variation ranging from 5 micrometers to 100 micrometers. The length of the donor belt is dependent on the configuration within which it is used, thus in FIGS. 1 and 2 the length varies from about 4 inches to about 20 inches. As indicated herein the donor belt means 18 in FIG. 1 forms an arc in relationship to roll 12, while in FIG. 2 donor belt means 18 does not form an arc. In the embodiment shown in FIG. 3, a belt is not utilized.

The drive roll means 20 in FIG. 1 is generally comprised of a conductive material, such as conductive rubber and the like, this roll having a diameter of from about 0.25 inches to 1.5 inches, and preferably from about 0.5 inches to 1 inch. The drive roll means 20 and idler roll means 22 of FIG. 2 are generally comprised of many conductive rubber segments formed by slots in both the circumferential and axial directions, which rubber segments enable tracking of the donor belt with the aid of belt edge guiding members. The compliant donor roll 20 shown in FIG. 3 generally consists of an elastic core, such as polyurethane foam or silicone rubber, overcoated with a seamless, flexible and conductive sleeve such as electroformed nickel or a carbon black loaded, extruded polymer. With regard to a rigid donor roll 20 shown in FIG. 9, various suitable materials can be selected, generally however, this roll consists of a hollow or solid triboelectrically active material comprised of numerous known substances such as stainless steel, electroformed nickel, aluminum, steel, iron, polymer materials, and the like, provided they are of sufficient surface texture and conductivity, which conductivity is achieved by adding dopants thereto. The conductive roll for either a compliant or rigid structure such as electroformed nickel can be overcoated with materials described hereinbefore for the donor belt 18 shown in FIGS. 1 and 2.

Illustrative examples of the image bearing member means 26, and 27, include inorganic and organic photoreceptor materials such as amorphous selenium, selenium alloys, including alloys of selenium-tellurium, selenium arsenic, selenium antimony, selenium-tellurium-arsenic, cadmium sulfide, zinc oxide, polyvinylcarbazole, layered organic photoreceptors, such as those containing as an injecting contact, carbon dispersed in a polymer, overcoated with a transport layer, which in turn is overcoated with a generating layer, and finally an overcoating of an insulating organic resin, such as those described in U.S. Pat. No. 4,251,612. Also, included within the scope of the present invention are imaging members comprised of a substrate, a transport layer such as a diamine dispersed in a polymer, and a generating layer such as trigonal selenium, as described in U.S. Pat. No. 4,265,990.

Other organic photoreceptor materials include, 4-dimethylaminobenzylidene, benzhydrazide; 2-benzylidene-amino-carbazole, 4-dimethylamino-benzylidene, 2-benzylidene-amino-carbazole, polyvinyl carbazole; (2-nitro-benzylidene)-p-bromo-aniline; 2,4-diphenyl quinazoline; 1,2,4-triazine; 1,5-diphenyl-3-methyl pyrazoline 2-(4'-dimethyl-amino phenyl)benzoxazole; 3-amino-carbazole; polyvinylcarbazole-trinitrofluorenone charge transfer complexes; phthalocyanines and mixtures thereof, and the like. Generally, positively charged toner compositions are employed when the photoreceptor is charged negatively as is the situation with most organic photoreceptors, while negatively charged toner particles are employed when the photoreceptor is charged positively, as is the situation with most inorganic photoreceptors such as selenium.

By flexible imaging member as used herein is meant generally a material that can be easily deformed, such as the members as described in U.S. Pat. No. 4,265,990. Examples of the use of flexible imaging members are shown in FIGS. 1, 2, 4, 6, 7, 8 and 9. In contrast, a rigid imaging member as shown in FIGS. 3 and 5 cannot be easily deflected, such members being stiff or hard, like amorphous selenium which has not been deposited on a flexible substrate.

The speed ratios of the components, the charging zone length, the development zone length, the voltages $V_C$, $V_B$, and other parameters of the apparatus and process of the present invention may vary depending on the configuration within which they are employed. Thus for example with reference to FIG. 1, the speed ratio of the metering roll 12 to the donor belt 18 varies from about −4 to about −1, and preferably is from about −2 to about −3. Accordingly, the metering roll 12 in this embodiment is moving at a more rapid rate of speed than the speed of the donor belt 18. In this embodiment, the speed ratio of the donor belt means 18 to the imaging member means 26 ranges from about 1 to about 4, and preferably is from about 2 to about 3, accordingly, the donor belt means 18 is moving from about 1 to about 4 times faster than the flexible photoreceptor imaging member means 26.

In reference to FIG. 2, the speed ratio of the roll 12, to the donor belt 18 ranges from about −2 to 0, and is preferably from about $-\frac{1}{2}$ to $-\frac{1}{3}$. Accordingly, in this embodiment, donor belt 18 is moving from about 2 times as fast as the roll 12, to a speed that is equal to the speed of the roll 12. In reference to FIGS. 3, 4 and 9, the speed ratios of the roll 12, and donor roll 20 are essentially identical to the speed ratio as described herein with reference to these components in FIG. 2.

With further reference to FIG. 1, the length $L_C$ of the metering/charging zone 34, ranges from about 0.08 inches to 1 inch, and is preferably from about 0.3 inches to 0.5 inches, while the length of the development zone 36 ($L_D$) ranges from about 0.05 inches to 0.5 inch and is preferably from about 0.06 inches to 0.1 inches. These distances can be greater or less providing they accomplish the objectives of the present invention.

In further reference to FIG. 2, the length $L_C$ ranges from about 0.05 to about 0.1 inches, and is preferably about 0.08 inches, while the length $L_D$ is substantially identical to the length $L_D$ with regard to FIG. 1. The lengths in FIGS. 3, 4 and 9, namely $L_C$ and $L_D$ are substantially identical to the lengths described herein with regard to FIG. 2, that is, for example a distance $L_C$ of from about 0.05 inches to about 0.1 inches, and preferably about 0.08 inches, with a length $L_D$ of approximately 0.05 inches, to about 0.5 inches and preferably from about 0.06 inches to about 0.10 inches.

With reference to FIG. 2, the pressure in the charging zone $L_C$ between the roll 12 and donor belt 18 is obtained by dividing the tension per unit width of donor belt 18 as applied by spring 24, by the radius of the roll. Generally the pressure ranges from about 0.1 to about 1 pounds per inch squared, and is preferably from about 0.2 pounds per inches squared, to about 0.7 pounds per inches squared. The pressure in the development zone between the donor electrode 18 and imaging member 26, which pressure is applied by a pressure blade 28 should be of sufficient magnitude to allow the toner particles to continually contact the imaging member. Generally, this pressure ranges from about 1 pound per inch squared to about 10 pounds per inch squared, and is preferably from about 2 pounds per inch squared to about 4 pounds per inch squared. With reference to FIG. 2, the force per unit blade length exerted by blade 28 ranges from about 0.05 to 1 pound per inch and preferably from about 0.1 to about 0.3 pounds per inch.

The blade 14 or **14*a*** is at an angle of from about 30 to about 180 degrees, and preferably is at an angle of from about 30 to about 45 degrees. For a blade angle greater than 90 degrees, the blade is a wiper with a preferred cleaning angle of 135 degrees to 180 degrees. The doctor blades can be of numerous suitable materials including plastics, nylon, steel, aluminum and the like.

For a positive toner charging system, the voltage $V_C$ ranges from about +25 volts to about +200 volts and is preferably from about +75 volts to about +125 volts with reference to FIGS. 1, 2, 3 and 9. The voltage $V_B$ generally ranges from about +75 volts to about +450 volts or from about −75 volts to −450 volts and is preferably from about −200 volts to −250 volts for photoreceptors negatively charged to an image potential of approximately −500 volts and a background potential of approximately −100 volts. The photoreceptor potentials are typical for an organic photoreceptor approximately 27 micrometers thick with a dielectric constant of 3.

With reference to the apparatus shown in FIG. 1, the speed ratio in a preferred embodiment is −3, the voltage $V_C$ is +100 volts, the voltage $V_B$ is −250 volts, the speed of the donor belt 18 to the imaging member 26 is +2, the nip length $L_C$ is 0.4 inches, and the nip length $L_D$ is 0.08 inches.

In each illustration, charging of the toner particles occurs in a charging zone situated between the metering roll, and a second component such as a donor belt or another roll. These components are self-spaced from each other by the toner particles situated therebetween, such spacing generally being equivalent to about one layer of toner particles. This distance may be less or more than one layer of toner particles.

The amount of toner particles 17 metered onto the donor belt means can be controlled as desired by varying the parameters of the system, however, generally the amount of toner particles deposited depends primarily on six factors, which are as follows:

1. The triboelectric charging relationship between for example the metering roll means and the coating contained on the transport means, such as the transport belt 18 as shown in FIG. 1, and the insulating toner particles 17.
2. The metering roll bias $V_C$.
3. The relative speed ratios between the metering roll means 12, and the donor belt means 18.
4. The length of the nip distance 34 ($L_C$), between the metering roll means 12 and the donor belt means 18.
5. The amount of pressure applied to the donor belt means 18. For example, if a high amount of pressure is applied there is virtually no spacing between the metering roll means 12 and the donor belt means 18, thus preventing toner particles 17 from moving into the charging nip $L_C$.
6. The degree of surface texture on the donor belt means 18.

Generally, the amount of toner particles deposited on the donor belt means 18 or rigid/compliant roll 20, can range from about 1 monolayer of toner particles to several layers of toner particles. The amount of toner particles deposited can, for example, range from about 0.1 milligrams per centimeter squared to 3 milligrams per centimeter squared and is preferably from about 0.5 milligrams per centimeter squared to 1 milligram per centimeter squared. The thickness of the toner layer deposited as indicated hereinbefore determines the distance between the metering roll and the donor belt or other roller as shown in the Figures.

As the toner layer is transported by movement of the donor belt, for example, the rubbing length, $L_r$, between the toner and metering roll is represented by the expression $L_r = |V-1| L_C$ wherein V is the ratio of the metering roll speed, to the donor speed and $L_C$ is the length of the toner charging zone 34. As V is negative for the two surfaces moving in opposite directions, a rubbing length of 1.6 inches is obtained when V is equal to $-3$, and $L_C$ is equal to 0.4 inches. The rubbing length needed for adequate toner charging depends, for example, primarily on the charging nip pressure, and the triboelectric charging between the toner, and metering roll and donor belt. The charging nip pressure is established by the belt tension, and the radius of the metering roll, it being noted that additional pressure can be supplied by a foam pad positioned against the back of the donor.

The development system described herein does not require magnetic toner, however, a mechanical and/or electrical means can be used to seal the ends of the development unit. Any materials such as foam or felt are suitable for this purpose. A magnetic seal with ferrofluid represents another sealing method. Furthermore, magnetic sealing could be obtained by simply using magnetic (insulative) toner, and appropriate magnets.

The agitated toner particles contained in the toner reservoir, can comprise numerous suitable insulating materials, and more specifically toner resins and colorants. Further, there can be contained in the toner composition charge enhancing additives, which will provide a mechanism by which the toner particles can be rapidly charged while at the same time maintaining such a charge.

Illustrative examples of resin materials include for example polyamides, epoxies, polyurethanes, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene, p-chlorostyrene vinyl naphthalene, ethylenically unsaturated monoolefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; styrene butadiene polymers and effective mixtures thereof.

Also esterification products of a dicarboxylic acid and a diol comprising a diphenol may be used as a resin material for the toner composition of the present invention. These materials are illustrated in U.S. Pat. No. 3,655,374, totally incorporated herein by reference, the diphenol reactant being of the formula as shown in column 4, beginning at line 5 of this patent and the dicarboxylic acid being of the formula as shown in column 6 of the above patent. The resin is present in an amount so that the total of all ingredients used in the toner total about 100%, thus when 5% by weight of the alkyl pyridinium compound is present and 10% by weight of pigment such as carbon black is present, about 85% by weight of resin material is used.

The toner resin particles can vary in diameter, but generally range from about 5 micrometers to about 30 micrometers in diameter, and preferably from about 10 micrometers to about 20 micrometers.

Various suitable pigments or dyes may be employed as the colorant for the toner particles, such materials being well known, and including for example, carbon black, nigrosine dye, aniline blue, calco oil blue, chrome yellow, ultramarine blue, DuPont oil red, methylene blue chloride, phthalocyanine blue and mixtures thereof. The pigment or dye should be present in sufficient quantity to render it highly colored so that it will form a clearly visible image on the recording member. For example, where conventional xerographic copies of documents are desired, the toner may comprise a black pigment such as carbon black or a black dye such as Amaplast black dye available from the National Aniline Products, Inc. Preferably the pigment is employed in amounts from about 3 percent to about 20 percent by weight based on the total weight of toner, however, if the colorant employed is a dye, substantially smaller quantities of the color may be used.

As indicated herein, there can be incorporated in the toner (resin plus colorant) various enhancing additives, primarily for the purpose of imparting a positive charge to the toner resin. Examples of such additives include quaternary ammonium compounds, and alkyl pyridinium halides, including cetyl pyridinium chloride.

Other modifications of the present invention will occur to those skilled in the art upon a reading of the present disclosure. These are intended to be included within the scope of the present invention.

We claim:

1. An apparatus for charging toner particles containing in operative relationship a rotating means for metering insulating toner particles and a deflected means for transporting and charging insulating toner particles, the means for metering, and the means for transporting being self-spaced by insulating toner particles situated therebetween, said means for metering and said means for transporting biased to a predetermined potential, and wherein the means for transporting contains a triboelectrically active coating thereon.

2. An apparatus in accordance with claim 1 wherein the insulating toner particles are charged to a positive polarity, or a negative polarity in a charging zone situated between the means for metering and the means for transporting.

3. An apparatus in accordance with claim 2 wherein the transporting means is textured.

4. An apparatus in accordance with claim 1 wherein the means for charging is moving in a direction opposite to the direction of movement of the means for transporting.

5. An apparatus in accordance with claim 1 further including a means for supplying insulating toner particles to the means for transporting.

6. An apparatus in accordance with claim 1 wherein the means for charging is a roller means.

7. An apparatus in accordance with claim 1 wherein the means for transporting is a belt means.

8. An apparatus in accordance with claim 1 wherein the means for charging is a roller, and the means for transporting is a roller.

9. An apparatus in accordance with claim 8 wherein compliant charging and compliant transporting rollers are utilized.

10. An apparatus in accordance with claim 1 wherein the deflection is in an arc of from about 10 degrees to about 50 degrees.

11. An apparatus in accordance with claim 1 further including a means for imaging, wherein the charged insulating toner particles are deposited thereon in image configuration.

12. An apparatus in accordance with claim 11 wherein the means for imaging is flexible or rigid.

13. An apparatus in accordance with claim 12 wherein the means for imaging is comprised of an inorganic photoconductive or an organic photoconductive composition.

14. An apparatus in accordance with claim 1 wherein the triboelectrically active coating is comprised of an electronegative material, or an electropositive material.

15. An apparatus in accordance with claim 14 wherein the coating thickness varies from about 0.1 mils to about 5 mils.

16. An apparatus in accordance with claim 14 wherein the electronegative material is selected from trifluorochloroethylene and vinylchloride copolymers, polyvinylidene fluorides, polytetrachlorofluoroethylenes, perfluoroalkoxylated ethylenes, polytetrafluoro alkoxy ethylenes, and polyvinyl chlorides and the electropositive materials are selected from polyvinylpyridenes, terpolymers or methacrylates, and thermoplastic toner resins.

17. An apparatus in accordance with claim 16 wherein the coating consists therein as an added ingredient, a charge dissipating agent.

18. An apparatus in accordance with claim 17 wherein the charge dissipating agent is carbon black.

19. An apparatus in accordance with claim 1 wherein the core of the metering roll is comprised of metals, or polymeric materials, and wherein the transporting means is a belt comprised of flexible polymeric materials.

20. An apparatus in accordance with claim 1 wherein the deflected transporting means is textured.

21. An apparatus for simultaneously metering and charging non-magnetic insulating toner particles containing in operative relationship a rotating metering means, a deflected means for transporting the toner particles, a means for supplying non-magnetic insulating toner particles to the transporting means, a means for applying a bias to the rotating metering means, a means for applying a bias to the transport means, a means for removing toner particles from the rotating metering means, the rotating metering means moving in a direction opposite to the direction of movement of the transporting means, the rotating metering means being self-spaced from the transporting means by the insulating toner particles contained therebetween, wherein the toner particles are charged to the appropriate polarity and magnitude in a charging zone situated between said rotating metering means, and said transporting means, and wherein the transporting means contains a triboelectrically active coating thereon.

22. An apparatus in accordance with claim 21 wherein the toner particles are charged to a positive or negative polarity in a fixed charging zone situated between the metering roll means, and the transporting means.

23. An apparatus in accordance with claim 21 wherein there is further included therein a flexible imaging member.

24. An apparatus in accordance with claim 23 wherein the flexible imaging member is comprised of inorganic photoconductive or organic photoconductive materials.

25. An apparatus in accordance with claim 24 wherein the inorganic material is comprised of amorphous selenium deposited on a flexible substrate, and the organic photoreceptor is comprised of an overcoated photoreceptor material comprised of a substrate, overcoated with a hole injecting layer, which in turn is overcoated with a hole transport layer, overcoated with a photogenerating layer, and an overcoating of insulating polymer.

26. An apparatus in accordance with claim 24 wherein the organic material is comprised of a substrate, a generating layer comprised of trigonal selenium or vanadyl phthalocyanine, and a transport layer comprised of a diamine dispersed in a polymer matrix.

27. An apparatus in accordance with claim 21 wherein the triboelectrically active coating is selected from electronegative materials, and electropositive materials.

28. An apparatus in accordance with claim 27 wherein the electronegative materials are polymers of trifluorochloroethylene and vinylchloride copolymers, polyvinylidene fluorides, polytetrachloroethylenes, perfluoroalkoxylated ethylenes, polytetrafluoro alkoxy ethylenes and polyvinyl chlorides, and the eletropositive materials are selected from polyvinylpyridenes, terpolymers of methacrylates, and thermoplastic toner resins.

29. An apparatus in accordance with claim 21 wherein the transporting means is textured.

30. An apparatus for simultaneously metering and charging non-magnetic insulating toner particles containing in operative relationship a rotating metering roll means, a doctor blade means for the metering roll means, a toner supply reservoir means containing therein weakly charged insulating toner particles possessing about an equal number of positive and negative charges thereon, a deflected transport donor belt means, a drive roll means, an idler means, a tensioning means for the transport donor belt means, an imaging means, a voltage source means for the metering roll means, a voltage source means for the drive roll means and the transport donor belt means, the metering roll means moving in a direction opposite to the direction of movement of the transport donor belt means, the metering roll means and the transport donor belt means being self-spaced by non-magnetic insulating toner particles situated therebetween, wherein the toner particles are charged to an appropriate polarity in a charging zone situated between the metering roll means and the transport donor belt means, and wherein the transport means contains a triboelectrically active coating thereover.

31. An apparatus in accordance with claim 30 wherein the transporting means is textured.

32. An apparatus for simultaneously metering and charging non-magnetic insulating toner particles containing in operative relationship a rotating metering roll means, a deflected transporting means, a drive roll means, an idler roll means, said transporting means forming a path of movement around said drive roll meand and said idler roll means, a toner supply reservoir means containing therein weakly charged insulating toner particles possessing about an equal number of positive and negative charges thereon, a voltage source means for the metering roll means, a voltage source means for the drive roll means, and the transporting means, a tensioning means for the transporting means, and an imaging member means, the metering roll means moving in a direction opposite the direction of movement of the transporting means, said metering roll means being self-spaced from the transport means by non-magnetic insulating toner particles situated therebetween, wherein the toner particles are charged to an appropriate polarity in a charging zone situated between the rotating metering roll means, and the deflected transporting means, and wherein the transport means contains a triboelectrically active coating thereover.

33. An apparatus for simultaneously metering and charging non-magnetic insulating toner particles containing in operative relationship a rotating metering roll means, a compliant transport donor roll means, a toner supply reservoir means containing therein weakly charged toner particles, a voltage source means for the rotating metering roll means, and a voltage source means for the compliant roller means, the metering roll means moving in a direction opposite to the direction of movement of the compliant roll means, said metering roll means and said compliant transport donor roll means being self-spaced by non-magnetic insulating toner particles contained therebetween, wherein the toner particles are charged to an appropriate polarity in a charging zone situated between the rotating charging roll means and the compliant transport donor roll means, and wherein the transporting means contains a triboelectrically active coating thereover.

34. An apparatus in accordance with claim 33 wherein the transporting means is textured.

35. An electrostatographic imaging device containing a charging means, an imaging means, a development means, a fixing means, and a fusing means, the improvement residing in the development means containing in operative relationship a rotating metering means, and a deflected means for transporting the insulating toner particles, the rotating means moving in a direction opposite to the direction of movement of the means for transporting, said rotating means and said means for transporting biased to a predetermined potential, and wherein said rotating means and said means for transporting are self-spaced by insulating toner particles situated therebetween, the toner particles being charged to an appropriate polarity in a charging zone situated between the means for charging and the means for transporting, and wherein the transporting means contans a triboelectrically active coating thereover.

36. An apparatus in accordance with claim 35 wherein the triboelectrically active coating is present in the rotating metering means in a thickness of from about 0.1 mils to about 5 mils, and wherein the triboelectrically active material is selected from electronegative compositions or electropositive compositions.

37. An electrostatographic imaging device containing a charging means, an imaging means, a development means, and a fixing means, the improvement residing in the development means for simultaneously metering and charging non-magnetic insulating toner particles, said development means containing in operative relationship a rotating charging roll means, a doctor blade means for the rotating metering roll means, a tonor supply reservoir means containing therein weakly charged insulating toner particles possessing about an equal number of positive and negative charges thereon, a deflected transport donor belt means, a drive roll means, an idler roll means, a tensioning means for the tranport donor belt means, an imaging means, a voltage source means for the rotating metering roll means, a voltage source means for the drive roll means, and the transport donor belt means, the rotating metering roll means moving in a direction opposite to the direction of movement of the deflected transporting donor belt means, said metering roll means being self-spaced from the deflected transporting donor belt means by non-magnetic insulating toner particles contained therebetween, wherein the tonor particles are charged to an appropriate polarity in a charging zone situated between the rotating metering roll means and the transporting donor belt means, and wherein the transporting means contans a triboelectrically active coating thereover.

38. An apparatus in accordance with claim 37 wherein the tranporting means is textured.

39. An electrostatographic imaging device containing a charging means, an imaging means, a development means, and a fixing means, the improvement residing in the development means for simultaneously metering and charging non-magnetic insulating toner particles, which means contains in operative relationship a rotating metering roll means, a deflected textured transporting means, a drive roll means, an idler roll means, said deflected transporting means forming a path of movement around said drive roll means and said idler roll means, a toner supply reservoir means containing therein weakly charged insulating toner particles possessing about a equal number of positive and negative charges thereon, a voltage source means for the metering roll means, a voltage source means for the drive roll means, and the transporting means, a tensioning means for the transporting means, and an imaging means, said metering charging roll means moving in a direction opposite to the direction of movement of the deflected transporting means, the metering roll means being self-spaced from the deflected transporting means by non-magnetic insulating toner particles contained therebetween, wherein the toner particles are charged to an appropriate polarity in a charging zone situated between the rotating metering roll means and the deflected transporting means, and wherein the transporting means contains a triboelectrically active coating thereover.

40. An apparatus in accordance with claim 39 wherein there is applied to the metering roll means a voltage of from about +25 volts to about +200 volts, or from about −25 volts to about −200 volts; and there is supplied to the drive roll means a voltage of from about +75 volts to about +450 volts, or from about −75 volts to about −450 volts.

41. An electrostatographic imaging device containing a charging means, an imaging means, a development means, and a fixing means, the improvement residing in the development means for simultaneously metering and charging non-magnetic insulating toner particles, said means containing in operative relationship a rotating metering roll means, a compliant transport donor roll means, a toner supply reservoir means containing therein weakly charged toner particles, a voltage source means for the rotating metering roll means, and a voltage source means for the compliant roller means, the metering roll means moving in a direction opposite to the direction of movement of the compliant roll means, said metering roll means and said compliant means being self-spaced by toner particles situated therebetween, and wherein the toner particles are charged to an appropriate polarity in a charging zone situated between the metering roll means and the compliant transport donor roll means, and wherein the transporting means contains a triboelectrically active coating thereover.

42. An apparatus for charging toner particles containing in operative relationship a rotating means for metering insulating toner particles and a rigid means for transporting and charging insulating toner particles, the means for metering, and the means for transporting being self-spaced by insulating toner particles situated therebetween, said means for metering and said means for transporting biased to a predetermined potential, and wherein the means for transporting contains a triboelectrically active coating thereon.

43. An apparatus for simultaneously metering and charging non-magnetic insulating toner particles containing in operative relationship a rotating metering means, a rigid means for transporting the toner particles, a means for supplying non-magnetic insulating toner particles to the transporting means, a means for applying a bias to the transport means, a means for removing toner particles from the rotating metering means, the rotating metering means moving in a direction opposite to the direction of movement of the transporting means, the rotating metering means being self-spaced from the transporting means by the insulating toner particles contained therebetween, wherein the toner particles are charged to the appropriate polarity and magnitude in a charging zone situated between said rotating metering means, and said transporting means, and wherein the transporting means contains a triboelectrically active coating thereon.

44. An apparatus for simultaneously metering and charging non-magnetic insulating toner particles containing in operative relationship a rigid rotating metering roll means, a deflective transporting means, a drive roll means, an idler roll means, said transporting means forming a path of movement around said drive roll means and said idler roll means, a toner supply reservoir means containing therein weakly charged insulating toner particles possessing about an equal number of positive and negative charges thereon, a voltage source means for the metering roll means, a voltage source means for the drive roll means, and the transporting means, a tensioning means for the transporting means, and an imaging member means, the metering roll means moving in a direction opposite to the direction of movement of the transporting means, said metering roll means being self-spaced from the transport means by non-magnetic insulating toner particles situated therebetween, wherein the toner particles are charged to an appropriate polarity in a charging zone situated between the rotating metering roll means, and the deflected transporting means, and wherein the transport means contains a triboelectrically active coating thereover.

45. An imaging device containing a charging means, an imaging means, a development means, a fixing means, and a fusing means the improvement residing in the development means, comprised in operative relationship of a rotating metering means, and a rigid means for transporting the insulating toner particles, the rotating means moving in a direction opposite to the direction of movement of the means for transporting, said rotating means and said means for transporting biased to a predetermined potential, and wherein said rotating means and said means for transporting are self-spaced by insulating toner particles situated therebetween, the toner particles being charged to an appropriate polarity in a charging zone situated between the means for charging and the means for transporting, and wherein the transporting means contains a triboelectrically active coating thereover.

46. An apparatus for charging toner particles containing in operative relationship a rotating means for metering insulating toner particles and a deflected means for transporting and charging insulating toner particles, the means for metering, and the means for transporting being self-spaced by insulating toner particles situated therebetween, said means for metering and said means for transporting biased to a predetermined potential.

47. An apparatus for simultaneously metering and charging non-magnetic insulating toner particles containing in operative relationship a rotating metering means, a deflected means for transporting the toner particles, a means for supplying non-magnetic insulating toner particles to the transporting means, a means for applying a bias to the rotating metering means, a means for applying a bias to the transport means, a means for removing toner particles from the rotating metering means, the rotating metering means moving in a direction opposite to the direction of movement of the transporting means, the rotating metering means being self-spaced from the transporting means by the insulating toner particles contained therebetween, wherein the toner particles are charged to the appropriate polarity and magnitude in a charging zone situated between said rotating metering means and said transporting means.

48. An apparatus for simultaneously metering and charging non-magnetic insulating toner particles containing in operative relationship a rotating metering roll means, a doctor blade means for the metering roll means, a toner supply reservoir means containing therein weakly charged insulating toner particles possessing about an equal number of positive and negative charges thereon, a deflected transporting belt means, a drive roll means, an idler means, a tensioning means for the deflected transporting belt means, an imaging means, a voltage source means for the metering roll means, a voltage source means for the drive roll means and the donor belt means, the metering roll means moving in a direction opposite to the direction of movement of the donor belt means, the metering roll means and the donor belt means being self-spaced by non-magnetic insulating toner particles situated therebetween, wherein the toner particles are charged to an appropriate polarity in a charging zone situated between the metering roll means and the donor belt means.

49. An apparatus for simultaneously metering and charging non-magnetic insulating toner particles containing in operative relationship a rotating metering roll means, a deflected transporting means, a drive roll means, an idler roll means, said transporting means forming a path of movement around said drive roll means and said idler roll means, a toner supply reservoir means containing therein weakly charged insulating toner particles possessing about an equal number of positive and negative charges thereon, a voltage source means for the metering roll means, a voltage source means for the drive roll means, and the transporting means, a tensioning means for the transporting means, and an imaging member means, the metering roll means moving in a direction opposite to the direction of movement of the transporting means, said metering roll means being self-spaced from the transport means by non-magnetic insulating toner particles situated therebetween, wherein the toner particles are charged to an appropriate polarity in a charging zone situated between the rotating metering roll means, and the deflected transporting means.

50. An electrostatographic imaging device containing a charging means, an imaging means, a development means, a fixing means, and a fusing means, the improvement residing in the development means containing in operative relationship a rotating metering means, and a deflected means for transporting and charging insulating toner particles, the rotating means moving in a direction opposite to the direction of movement of the means for transporting, said rotating means and said means for transporting biased to a predetermined potential, and wherein said rotating means and said means for transporting are self-spaced by insulating toner particles present therebetween, the toner particles being charged to an appropriate polarity in a charging zone situated between the means for charging and the means for transporting.

51. An electrostatographic imaging device containing a charging means, an imaging means, a development means, and a fixing means, the improvement residing in the development means for simultaneously metering and charging non-magnetic insulating toner particles, which means contains in operative relationship a rotating metering roll means, a deflected textured transporting means, a drive roll means, an idler roll means, said deflected transporting means forming a path of movement around said drive roll means and said idle roll means, a toner supply reservoir means containing therein weakly charged insulating toner particles possessing about an equal number of positive and negative charges thereon, a voltage source means for the metering roll means, a voltage source means for the drive roll means, and the transporting means, a tensioning means for the transporting means, and an imaging means, said metering charging roll means moving in a direction opposite to the direction of movement of the deflected transporting means, the metering roll means being self-spaced from the deflected transporting means by non-magnetic insulating toner particles contained therebetween, wherein the toner particles are charged to an appropriate polarity in a charging zone situated between the rotating metering roll means and the deflected transporting means.

52. An improved process for charging non-magnetic insulating toner particles which comprises (1) providing a rotating metering means, (2) providing a deflected transporting means containing a triboelectrically active coating thereover, (3) depositing weakly charged insulating toner particles on the transporting means, (4) contacting the weakly charged toner particles with the triboelectrically active coating, said contact occurring in a charging zone situated between the rotating means and the deflected transporting means, (5) causing the rotating means to move in a direction opposite to the direction of movement of the deflected transporting means, the rotating means and the means for transporting being self-spaced by the toner particles contained therebetween, wherein the toner particles are charged to an appropriate polarity in a charging zone situated between the rotating charging means and the deflected transporting means.

53. A process in accordance with claim 52 wherein the resulting charged toner particles are deposited on an imaging member, said deposition occurring in a development zone situated between the transporting means, and the imaging member.

54. A process in accordance with claim 53 wherein the imaging member is flexible or rigid and is selected from inorganic compositions or organic compositions.

55. A process in accordance with claim 54 wherein the flexible imaging member is comprised of amorphous selenium deposited on a flexible substrate, or an organic composition comprised of a substrate, a transport layer, and a generating layer.

56. A process in accordance with claim 54 wherein there is further provided a pressure blade means situated in contact with the flexible imaging member, which means exerts pressure on said member, enabling constant contact with the charged toner particles.

57. A process in accordance with claim 52 wherein the triboelectrically active coating is of a thickness of from about 0.1 mils to about 3 mils, said material being selected from electronegative materials or electropositive materials.

58. A process in accordance with claim 57 wherein the electronegative material is selected from trifluorochloroethylene and vinylchloride copolymers, polyvinylidene fluorides, polytetrachlorofluoroethylenes, perfluoralkoxylated ethylenes, polytetrafluoro alkoxy ethylenes, and polyvinyl chlorides and the electropositive materials are selected from polyvinylpyridenes, terpolymers of methacrylates, and thermoplastic toner resins.

59. A process for simultaneously metering and charging non-magnetic insulating toner particles to a positive or negative polarity consisting essentially of (1) providing a rotating metering roll, (2) providing a toner supply means containing therein weakly charged insulating toner particles possessing an approximately equal number of positive charges and an approximately equal number of negative charges, (3) providing a deflected toner transport charging means containing a triboelectrically active coating thereover, (4) providing a drive roll means and an idler roll means wherein the deflected transporting means traverses a path around said drive roll means and said idler roll means, (5) providing a voltage source means for the metering and charging roll means, (6) providing a voltage source means for the drive roll means and the transport means, (7) causing weakly charged insulating toner particles to deposit on the transport means, which deposition is controlled by the rotating metering roll means, (8) causing the rotating metering roll means to move in a direction opposite to the direction of movement of the deflected transporting means, said metering roll means and said deflected transporting means being self-spaced by insulating toner particles contained therebetween, (9) contacting the toner particles with the transport means in a charging zone situated between said metering means and said deflected transporting means, whereat charges on the toner particles are amplified to a positive or negative polarity.

60. A process in accordance with claim 59 wherein the triboelectrically active coating is selected from electropositive materials, or electronegative materials.

61. A process in accordance with claim 60 wherein the electronegative material is selected from trifluorochloroethylene and vinylchloride copolymers, polyvinylidene fluorides, polytetrachlorofluoroethylenes, perfluoroalkoxylated ethylenes, polytetrafluoro alkoxy ethylenes, and polyvinyl chlorides and the electropositive materials are selected from polyvinylpyridenes, terpolymers of methacrylates, and thermoplastic toner resins.

62. A process for simultaneously metering and charging insulating toner particles consisting essentially of (1) providing a rotating metering roll, (2) providing a compliant charging transport roll means, (3) providing a toner supply means containing therein weakly charged insulating toner particles possessing an approximately equal number of positive charges and an approximately equal number of negative charges, (4) providing a voltage source means for the metering roll means, (5) providing a voltage source means for the compliant roller means, (6) causing toner particles to deposit and migrate on the compliant roller means, (7) causing the rotating metering roll means to move in a direction opposite to the direction of movement of the compliant roll means, said rotating metering roll means being self-spaced from the compliant roller means by insulating toner particles situated therebetween, (8) contacting the toner particles with the transport means in a charging zone situated between the rotating metering roll and the compliant roll means, wherein toner particles are charged to a positive or negative polarity, the compliant roll means containing a triboelectrically active coating thereover.

63. A process for charging non-magnetic insulating toner particles which comprises providing a rigid rotating metering means, providing a deflective transporting means, containing a triboelectrically active coating thereover, depositing weakly charged insulating toner particles on the transporting means, contacting the weakly charged toner particles with the triboelectrically active coating, said contact occurring in a charging zone situated between the rotating means and the deflected transporting means, causing the rotating means to move in a direction opposite to the direction of movement of the deflected transporting means, the rotating means and the means for transporting being self-spaced by the toner particles contained therebetween, wherein the toner particles are charged to an appropriate polarity in a charging zone situated between the rotating charging means and the deflected transporting means.

64. An improved process for charging non-magnetic insulating toner particles which comprises (1) providing a rotating metering means, (2) providing a deflected transporting means with a triboelectrically active coating thereover, (3) depositing weakly charged insulating toner particles on the transporting means, (4) contacting the weakly charged toner particles with the triboelectrically active coating, said contact occurring in a charging zone situated between the rotating means and the deflected transporting means, (5) causing the rotating means to move in a direction opposite to the direction of movement of the deflected transporting means, the rotating means and the means for transporting being self-spaced by the toner particles contained therebetween, wherein the toner particles are charged to an appropriate polarity in a charging zone situated between the rotating metering means and the deflected transporting means.

65. A process for simultaneously metering and charging non-magnetic insulating toner particles to a positive or negative polarity consisting essentially of (1) providing a rotating metering roll, (2) providing a toner supply means containing therein weakly charged insulating toner particles possessing an approximately equal number of positive charges and an approximately equal number of negative charges, (3) providing a deflected toner transporting charging means, (4) providing a drive roll means and an idler roll means wherein the deflected transporting means traverses a path around said drive roll means and said idler roll means, (5) providing a voltage source means for the rotating roll, (6) providing a voltage source means for the drive roll means and the transport means, (7) causing weakly charged insulating toner particles to deposit on the transport means, which deposition is controlled by the rotating metering roll means, (8) causing the rotating metering roll means to move in a direction opposite to the direction of movement of the deflected transporting means, said metering roll means and said deflected transporting means being self-spaced by insulating toner particles contained therebetween, (9) contacting the toner particles with the transporting means in a charging zone situated between said metering means and said deflected transporting means, whereat charges on the toner particles are amplified to a positive or negative polarity.

66. A process for simultaneously metering and charging insulating toner particles consisting essentially of (1) providing a rotating metering roll, (2) providing a compliant charging transport roll means, (3) providing a toner supply means containing therein weakly charged insulating toner particles possessing an approximately equal number of positive charges and an approximately equal number of negative charges (4) providing a voltage source means for the rotating metering roll, (5)

providing a voltage source means for the compliant roller means, (6) causing toner particles to deposit and migrate on the compliant roller means, (7) causing the rotating metering roll means to move in a direction opposite to the direction of movement of the compliant roll means, said rotating metering roll means being self-spaced from the compliant roller means by insulating toner particles situated therebetween, (8) contacting the toner particles with the transport means in a charging zone situated between the rotating metering roll and the compliant roll means, wherein toner particles are charged to a positive or negative polarity, and wherein the compliant roll means contains a triboelectrically active coating thereover.

* * * * *